US006235075B1

(12) United States Patent
Hofmann et al.

(10) Patent No.: US 6,235,075 B1
(45) Date of Patent: May 22, 2001

(54) METHOD AND DEVICE FOR PRODUCING SILICON-RICH FOUNDRY IRON

(75) Inventors: Werner Hofmann; Wolfgang Reichelt, both of Moers (DE)

(73) Assignee: Mannesmann Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/011,416

(22) PCT Filed: Jul. 25, 1997

(86) PCT No.: PCT/DE97/01609

§ 371 Date: Mar. 6, 1998

§ 102(e) Date: Mar. 6, 1998

(87) PCT Pub. No.: WO98/05800

PCT Pub. Date: Feb. 12, 1998

(30) Foreign Application Priority Data

Aug. 2, 1996 (DE) ..... 196 32 403

(51) Int. Cl.[7] ..... C21B 11/10

(52) U.S. Cl. ..... 75/10.5; 266/176; 373/81; 420/33

(58) Field of Search ..... 75/10.5, 10.1; 420/33, 117; 373/79, 80, 81; 266/176

(56) References Cited

U.S. PATENT DOCUMENTS 3,919,454 * 11/1975 Langhammer ..... 373/80
3,985,545 10/1976 Kinoshita .
5,588,982 * 12/1996 Hendrix ..... 420/33

FOREIGN PATENT DOCUMENTS 2535284 8/1975 (DE) .
PCT/DE93/10348 5/1994 (WO) .
PCT/AU95/00563 9/1995 (WO) .

* cited by examiner

*Primary Examiner*—Melvyn Andrews
(74) *Attorney, Agent, or Firm*—Cohen, Pontani, Lieberman & Pavane

(57) ABSTRACT

Disclosed is a process and apparatus for generating high-silicon foundry pig iron. In the process:

a) silicon oxides and iron-carbon metals are charged in a shaft furnace;

b) the charge is kept under a highly reducing atmosphere;

c) the material column is guided annularly at least in the vicinity of the vessel bottom and d) exposed to the radiation heat of a heat source located in the free space in the outlet region of the annular material column above the furnace base.

The furnace has a centrally arranged electrode, which projects into the furnace vessel and is guided up to the vicinity of the base, and a counterelectrode arranged in the base of the furnace vessel. The electrode projecting into the vessel is enclosed by a coaxially guided sleeve whose outer diameter "d" is in a ratio to the inner diameter "D" of the furnace vessel such that d;D is about 1:4. The sleeve mouth is at a distance "a" from the base of the furnace vessel such that $2 \times d \leqq a \leqq 4 \times d$.

13 Claims, 3 Drawing Sheets

METHOD AND DEVICE FOR PRODUCING SILICON-RICH FOUNDRY IRON

BACKGROUND OF THE INVENTION

The invention is directed to a process for producing a high-silicon foundry pig iron and to a uniflow furnace with a centrally arranged electrode, which projects into the furnace vessel and is guided up to the vicinity of the base, and a counterelectrode arranged in the base of the furnace vessel for carrying out the process.

High-silicon foundry pig iron is an alloy of iron with about 3% carbon and up to 20% silicon. The iron alloy is smelted in foundries and has a silicon content for example of approximately 2.5%, in order to produce spun- or centrifugal-cast pipe which is principally used for water lines.

Foundry pig iron is usually smelted in a cupola furnace and the compostion is subsequently adjusted as appropriate by alloying with ferrosilicon. A disadvantage in this method is the high price of FeSi.

The object of the invention is to provide a process and corresponding apparatus in which the end alloy of the high-silicon foundry pig iron is smelted directly in a simple and economical manner.

SUMMARY OF THE INVENTION

This object is met by the invention.

In the invention, silicon oxides and iron-containing charge materials such as scrap, sponge iron, briquetted sponge iron, etc. and carbon-containing charge materials for reducing the silicon oxides and for carburizing are charged into a shaft furnace wherein the charge is guided through a ring shaft. The furnace interior is maintained under a highly reducing atmosphere, and the charge is melted by means of the radiation heat, especially by means of a transmitting or transferring arc.

Guiding the charge materials in a ring shaft prevents contact between the charge materials and the electrode. If the highly electrically conductive charge materials such as scrap, sponge iron, briquetted sponge iron and coal/coke were to contact the electrode, this would result in a short circuit and it would not be possible to supply the electrical power needed for the process. If an electrode is to be used, the material must be kept away from this heat source. As a result of the free space, the arc is maintained without hindrance between the graphite electrode and the molten bath. Due to the radiated energy of the arc, the charge materials pushed through the inner vessel to the edge of the furnace are melted and the energy required for the reduction of the silicon oxide is provided.

The melting process which is brought about by electrical energy is independent of the electrical conductivity of the charge materials as well as from its charging angle or angle of repose. Further, there are no special requirements with regard to the size of the charge materials. Thus, for example, the size of the usable scrap pieces is limited only by the clearance of the ring shaft.

In another embodiment of the invention, the silicon oxides are introduced directly and independently from the normal material column. The silicon oxide can be introduced into the furnace by a material lance through a hollow electrode. Accordingly, it is possible to melt exactly metered quantities of silicon oxide of sufficiently fine granulation in the shortest possible time. This silicon oxide condenses on the relatively cool coal located farther up the shaft. In so doing, it undergoes a transformation and is included in the melt as the charge continues to sink.

If separate feed means are not used for introducing the silicon oxide, the charge material is carefully mixed with the silicon oxide prior to introduction into the furnace;

In order to carry out the process, a low shaft furnace is used which has a ring shaft having a combustion space. The combustion space is maintained as an open volume during the entire process, allowing for the charge angle of the charge material, so that the radiant heat can be transferred to the material without hindrance.

Preferably, the inner shaft is of a conical construction so that the charge materials can be guided in the direction of the furnace base without interference. The size of the ring shaft is such that the charge materials are allowed to melt reliably.

In order to carry out the process, furnace vessel is closed and a highly reducing atmosphere is closed and maintained therein thus enabling the safe reduction of the silicon oxide. The silicon content of the charge materials can be up to 20%.

The following iron carriers are used: 80% shredder, 10% turnings, 5% tin cans, and 5% iron turnings.

The iron carriers mentioned above can be replaced in a further step by iron ore or sponge iron.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DETAILED DESCRIPTION OF THE PRESENTLY PREFERRED EMBODIMENTS

Figure 1:
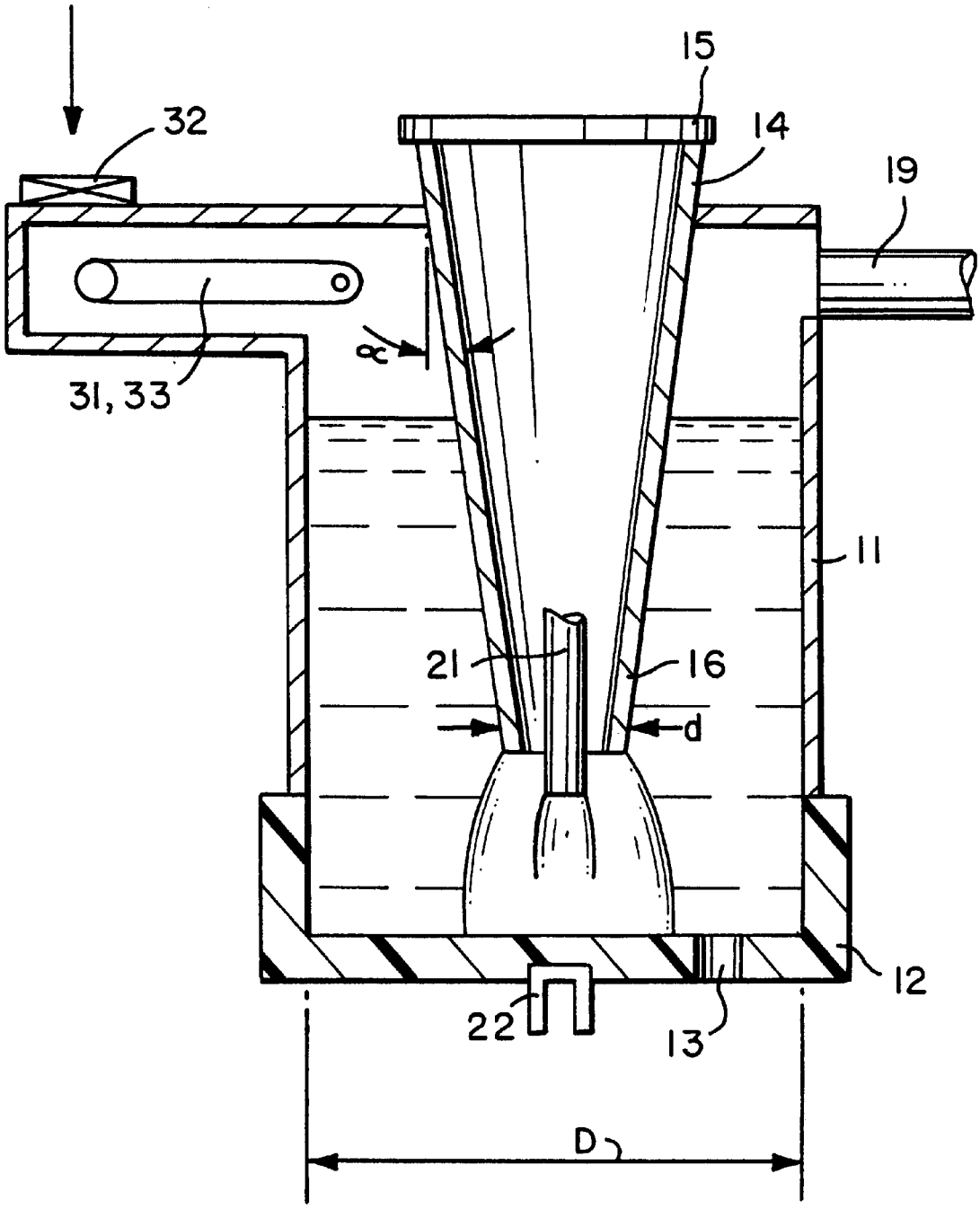
FIG. 1 shows in cutaway a schematic front elevation view of a furnace provided with a center electrode, which furnace has an annular, conically narrowing internal flow shaft.
Figure 2:
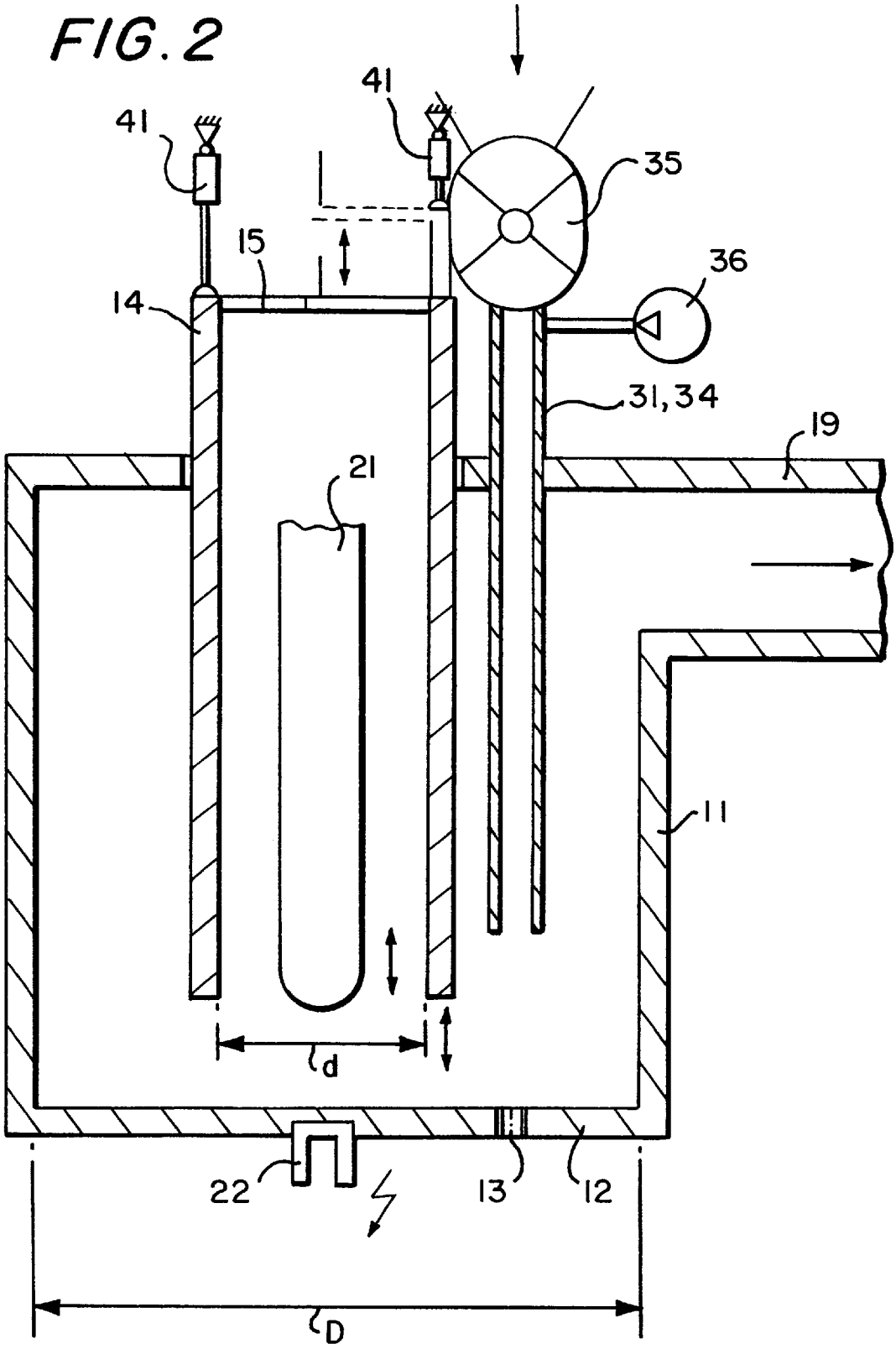
FIG. 2 is a cutaway schematic front elevation view of a shaft furnace with an electrode which is enclosed by an annular sleeve and a material feed lance which is guided parallel to the sleeve.
Figure 3:
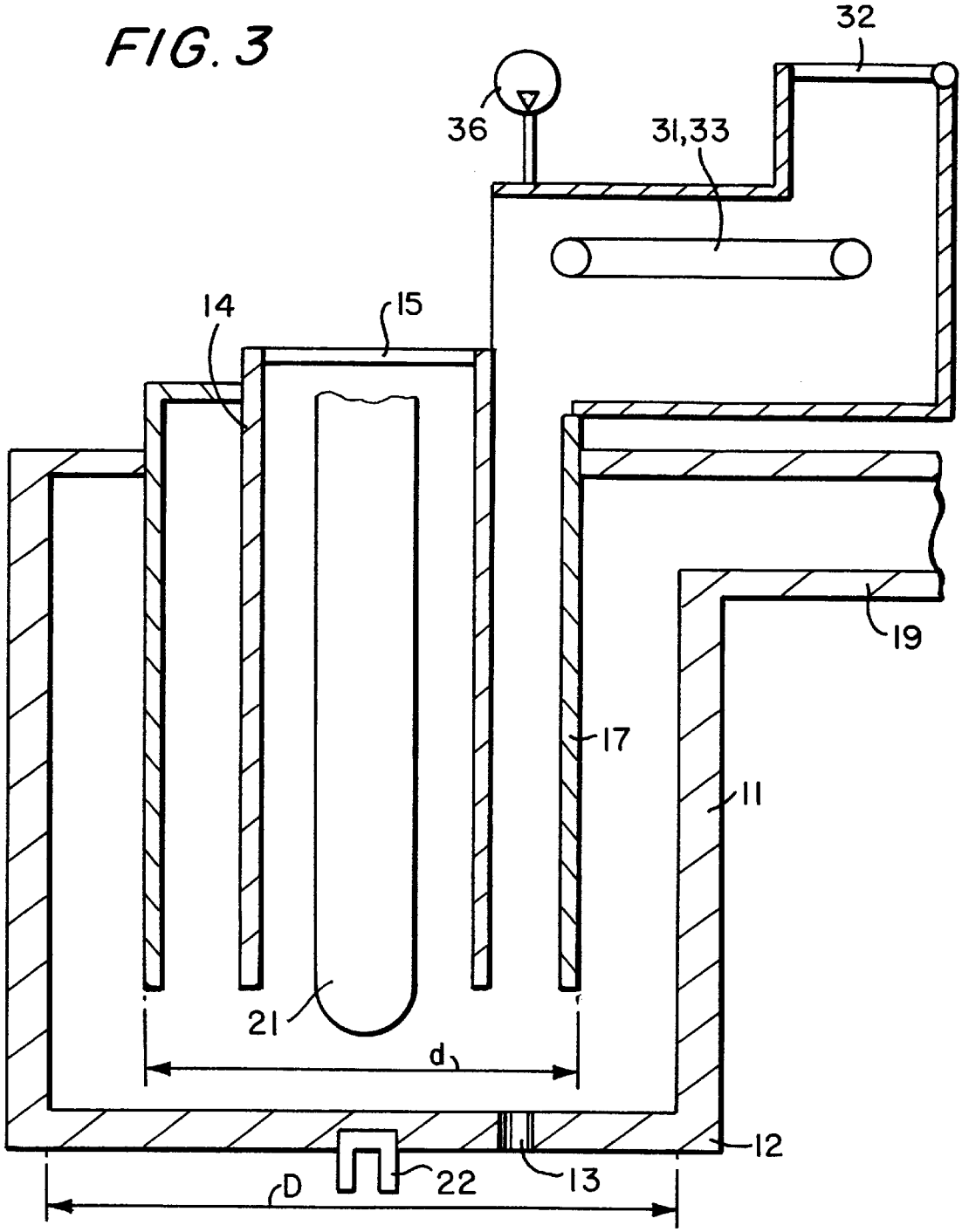
FIG. 3 shows a material feed sleeve which encloses the protective sleeve for the center electrode.

FIGS. 1 to 3 show a furnace vessel 11 which has a furnace base 12 having a base opening 13 and a gas discharge 19.

The outer diameter of the sleeve is designated by "d" and the inner diameter of the furnace vessel 11 is designated by "D".

In FIG. 1, a sleeve 14, enclosing an electrode 21, projects into the furnace vessel. A counterelectrode 22 is provided in the base 13.

The sleeve enclosing the electrode is itself closed by a cover 15.

In FIG. 1, the sleeve is constructed conically, wherein it narrows in diameter at an angle $\alpha$ from the vertical in the direction of the furnace base. A feed device 31 such as a conveyor belt 33, is provided in the region of the furnace head. The feed device can be loaded or charged via a lock 32.

In FIG. 2, the sleeve 14 is vertically displaceable by displacing elements 41. Further, a lance 34 is provided in FIG. 2 as a material feed device 31, a lock wheel 35 being arranged at the inlet end of the lance 34. Further, the lance 34 is connected with a pump 36 by means of which the supplied material can be transported pneumatically.

In FIG. 3, the sleeve 14 is enclosed by a double-sleeve 17. The intermediate space between the sleeves 14 and 17 is used as a material feed in which the charge is supplied by means of a feed device 31, in this case a conveyor belt 33, which is transportable via a lock 32 to the belt 33. Further, an additional pump 36 is connected to the feed device.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

What is claimed is:

1. A process for generating high-silicon foundry pig iron, comprising:

charging a material comprising a mixture of silicon oxide and iron-carbon metal into a shaft furnace, said furnace having an electrode a base, a counterelectrode arranged in the base, an outlet region and an annular area;

guiding the charged material annularly at least in the vicinity of the furnace base;

maintaining the charged material under a highly reducing atmosphere in the furnace; and exposing the charged material to radiation heat from a heat source located in a free space in the outlet region of the annular material column above the furnace base.

2. The process of claim 1 wherein the heat source is a transmitting arc.

3. The process of claim 1 wherein the charged material comprises iron carriers including 80% shredder, 10% turnings, 5% tin cans, and 5% in-plant scrap.

4. The process of claim 1 wherein the charged material comprises iron ore.

5. The process of claim 1 wherein the charged material comprises sponge iron.

6. The process of claim 1 wherein the silicon oxides are transported directly into the free space and exposed to the radiation heat.

7. A furnace comprising:

a furnace vessel having a base and an inner diameter "D";

a centrally arranged electrode which projects into the furnace vessel and is guided to the vicinity of the base;

a counter electrode arranged in the base of the furnace vessel;

a coaxially guided sleeve enclosing said electrode, the sleeve having an outer diameter "d", wherein the ratio of d:D is about 1:4, and said sleeve has an opening at a distance "a" from the base of the furnace vessel so that $2\times d \leqq a \leqq 4\times d$.

8. The furnace of claim 7 wherein the sleeve is conical and narrows in the direction of the furnace base at a cone angle "$\alpha$" of 4° to 6°.

9. The furnace of claim 7 wherein the sleeve is vertically displaceable with respect to the base of the furnace vessel.

10. The furnace of claim 7 further comprising a feeding device which projects into the vessel optionally up to the mouth of the sleeve.

11. The furnace of claim 10 wherein the feeding device is a material lance connected to a conveying device.

12. The furnace of claim 10 wherein the feeding device comprises a tubular casing which encloses the sleeve.

13. The furnace of claim 7 wherein the electrode projecting into the vessel is a hollow electrode.

* * * * *